US011152742B2

(12) United States Patent
Aoki et al.

(10) Patent No.: US 11,152,742 B2
(45) Date of Patent: Oct. 19, 2021

(54) CONNECTOR COVER, CONTINUOUS STRUCTURE CAPABLE OF PRODUCING CONNECTOR COVER, AND PRODUCTION METHOD FOR CONNECTOR COVER

(71) Applicant: JAPAN AVIATION ELECTRONICS INDUSTRY, LIMITED, Tokyo (JP)

(72) Inventors: Shigeharu Aoki, Tokyo (JP); Akira Kimura, Tokyo (JP); Kiichi Hori, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 49 days.

(21) Appl. No.: 16/426,433

(22) Filed: May 30, 2019

(65) Prior Publication Data

US 2019/0379156 A1 Dec. 12, 2019

(30) Foreign Application Priority Data

Jun. 6, 2018 (JP) ..... JP2018-108765

(51) Int. Cl.
*H01R 13/52* (2006.01)
*H01R 43/00* (2006.01)
(Continued)

(52) U.S. Cl.
CPC ..... *H01R 13/5213* (2013.01); *H01R 43/005* (2013.01); *H01R 12/716* (2013.01); *H01R 13/447* (2013.01); *H01R 43/18* (2013.01)

(58) Field of Classification Search
CPC ..... H01R 13/5216; H01R 43/005; H01R 12/716; H01R 13/447; H01R 24/58; H01R 24/60; H01R 13/46; H01R 43/18
See application file for complete search history.

(56) References Cited

U.S. PATENT DOCUMENTS 6,135,795 A 10/2000 Ho
9,882,289 B2 * 1/2018 Seipel ..... H01R 43/16
(Continued)

FOREIGN PATENT DOCUMENTS

CN 206532931 U 9/2017
EP 0716483 A2 6/1996
(Continued)

OTHER PUBLICATIONS

Office Action issued in Taiwan family member Patent Appl. No. 108118898, dated Mar. 10, 2020, along with an English translation thereof.

(Continued)

*Primary Examiner* — Renee S Luebke
*Assistant Examiner* — Paul D Baillargeon
(74) *Attorney, Agent, or Firm* — Greenblum & Bernstein, P.L.C.

(57) ABSTRACT

A continuous structure capable of producing a connector cover is made from a single strip-shaped flat plate. The continuous structure has a structure in which a unit structure repeatedly and regularly appears in a longitudinal direction of the strip-shaped flat plate. The unit structure includes a flat-plate portion and two side wall portion groups. One of the two side wall portion groups includes a first side wall portion standing on one of two edges of the flat-plate portion in a width direction of the flat-plate portion, and the other of the two side wall portion groups includes a second side wall portion standing on the other of the two edges of the flat-plate portion. The second side wall portion is a spring portion which generates pressing force in the width direction. The first side wall portion faces the second side wall portion.

8 Claims, 12 Drawing Sheets

(51) Int. Cl.

| | |
|---|---|
| ***H01R 12/71*** | (2011.01) |
| ***H01R 13/447*** | (2006.01) |
| ***H01R 43/18*** | (2006.01) |

(56) References Cited

U.S. PATENT DOCUMENTS

| | | | |
|---|---|---|---|
| 2008/0119082 | A1 | 5/2008 | Cheng |
| 2018/0205177 | A1 | 7/2018 | Zhou et al. |

FOREIGN PATENT DOCUMENTS

| | | | |
|---|---|---|---|
| EP | 716483 | A2 | 5/1999 |
| EP | 0917249 | A2 | 5/1999 |
| GB | 2330249 | A | 4/1999 |
| JP | H11-126672 | A | 5/1999 |
| TW | 326992 | U | 2/1998 |
| TW | 523193 | | 3/2003 |

OTHER PUBLICATIONS

Office Action issued in Chinese Counterpart Patent Appl. No. 201910467590.1, dated Jul. 2, 2020, along with an English translation thereof.

Office Action issued in European Patent Office (EPO) family member Patent Appl. No. 19177916.4, dated Jan. 27, 2020.

* cited by examiner

CONNECTOR COVER, CONTINUOUS STRUCTURE CAPABLE OF PRODUCING CONNECTOR COVER, AND PRODUCTION METHOD FOR CONNECTOR COVER

TECHNICAL FIELD

The present invention relates to a connector cover to be attached to a connector, a continuous structure capable of producing the connector cover, and a production method for the connector cover.

BACKGROUND ART

At the time of automatic mounting of connectors on a board, suction transport of a connector, to which a connector cover with a flat suction surface is attached, is performed.

FIGS. 1A and 1B show a connector cover disclosed in Japanese Patent Application Laid Open No. 11-126672 (hereinafter referred to as "Patent Literature 1"), the connector cover being referred to as a "adsorptive member for connector" in Patent Literature 1. FIGS. 2A and 2B show a connector, to which the connector cover shown in FIGS. 1A and 1B is attached.

A connector cover 10 includes an elongated flat-plate portion 11 which has a flat upper surface 11*a*, four legs 12 which extend downward from the flat-plate portion 11, one pair of ribs 13 which are formed along a longitudinal direction of the connector cover 10, one pair of tongue pieces 14, one pair of tongue pieces 15, and one pair of tongue pieces 16. The one pair of tongue pieces 14, the one pair of tongue pieces 15, and the one pair of tongue pieces 16 are located near two ends in the longitudinal direction. Each leg 12 is formed integrally with the rib 13 as a thickness-increased portion of the rib 13. The leg 12 has a projection 12*a* which protrudes outward.

The tongue pieces 14 are located on outermost sides of the flat-plate portion 11. The tongue pieces 15 are located on inner sides of the flat-plate portion 11 away from the tongue pieces 14. The tongue pieces 14 and 15 are orthogonal to the flat-plate portion 11 and extend downward. The tongue pieces 15 are formed integrally with one of the ribs 13. The tongue pieces 15 are thickness-increased portions at two end portions of the one rib 13. The tongue pieces 16 are thickness-increased portions at two end portions of the other rib 13. A dimension of each tongue piece 16 in the longitudinal direction of the connector cover 10 is slightly shorter than a dimension of each tongue piece 15 in the longitudinal direction. For this reason, a position of an outermost end 16*a* of the tongue piece 16 does not coincide with a position of an outermost end 15*a* of the tongue piece 15.

FIG. 2A shows a state in which the connector cover 10 is attached to a connector 20 which has a predetermined number of contacts (also referred to as pins, poles, or the like). The connector 20 includes a housing 21, contacts 22, and a shell 23. The tongue pieces 15 and 16 of the connector cover 10 are inserted in a fitting recess inside a mating portion 23*a* of the shell 23. Since dimensions of the outermost ends 15*a* and 16*a* of the tongue pieces 15 and 16 are determined so as to suit an inner surface shape of the mating portion 23*a*, the connector cover 10 relative to the connector 20 is positioned by the tongue pieces 15 and 16. The projections 12*a* of the legs 12 engage with dimples 23*b* which are formed in the mating portion 23*a*, thereby fixing the connector cover 10 to the connector 20. Since the tongue pieces 14 do not engage with the mating portion 23*a*, the tongue pieces 14 are not involved in alignment of the connector cover 10.

FIG. 2B shows a state in which the connector cover 10 is attached to a connector 20*g* which has contacts slightly larger in number than the connector 20 shown in FIG. 2A and has a larger dimension in a longitudinal direction of a mating portion 23*ag*. Since the mating portion 23*ag* is slightly longer than the mating portion 23*a*, when the connector cover 10 is attached to the connector 20*g*, inner surfaces of the tongue pieces 14 receive outer end portions of the mating portion 23*ag*. Since the inner surfaces of the tongue pieces 14 have the same shapes as corresponding outer surfaces of the mating portion 23*ag*, the connector cover 10 relative to the connector 20*g* is positioned by the tongue pieces 14.

The connector cover 10 disclosed in Patent Literature 1 is shared by the two types of connectors 20 and 20*g* different in the length of a mating portion. Patent Literature 1 also discloses that the connector cover can be attached to a connector smaller in the number of contacts than the connector 20 by forming other tongue pieces on inner sides of the ribs 13 in the longitudinal direction.

Sharing of a single connector cover having a predefined length by two or more connectors different in the length of a mating portion means that the connector cover has an inappropriate length (that is, an excessive length) for the connectors other than one having a longest mating portion.

The excessive length of the connector cover can cause interference with other mounted components on a board, a housing, and the like at the time of connector mounting and leads to increase in dead space. Additionally, increase in the size of a storage tray for a connector, to which the connector cover is attached, is inevitable.

SUMMARY OF THE INVENTION

An object of the present invention is to provide a continuous structure capable of producing a connector cover which can inexpensively produce connector covers having respective lengths appropriate for connectors different in the number of contacts, a method for producing a connector cover from the continuous structure, and the connector cover itself.

A continuous structure according to the present invention is a continuous structure capable of producing a connector cover and is or includes a unitary structure made from a single strip-shaped flat plate. The unitary structure includes a regular repetition of a predetermined structure (a unit structure) in a longitudinal direction of the strip-shaped flat plate. The unit structure includes a flat-plate portion and two side wall portion groups. One of the two side wall portion groups includes a first side wall portion standing on one of two edges of the flat-plate portion in a width direction of the flat-plate portion, and the other of the two side wall portion groups includes a second side wall portion standing on the other of the two edges of the flat-plate portion. The second side wall portion is a spring portion which generates pressing force in the width direction. The first side wall portion faces the second side wall portion.

A production method according to the present invention includes cutting the above-described continuous structure to a length including the first side wall portion and the second side wall portion as a pair.

A connector cover according to the present invention is or includes a unitary structure made from a single strip-shaped flat plate. The unitary structure has a part of a regular repetition of a predetermined structure (a unit structure) in a longitudinal direction of the strip-shaped flat plate. The unitary structure has a length n times the unit structure, where n is larger than 1 and not limited to an integer. The unit structure includes a flat-plate portion and two side wall portion groups. One of the two side wall portion groups includes a first side wall portion standing on one of two edges of the flat-plate portion in a width direction of the flat-plate portion, and the other of the two side wall portion groups includes a second side wall portion standing on the other of the two edges of the flat-plate portion. The second side wall portion is a spring portion which generates pressing force in the width direction. The first side wall portion faces the second side wall portion.

From a different viewpoint, a connector cover according to the present invention is as follows. The connector cover according to the present invention is or includes a unitary structure made from a single strip-shaped flat plate. The unitary structure has a part of a regular repetition of a predetermined structure (a unit structure) in a longitudinal direction of the strip-shaped flat plate. The unit structure includes a flat-plate portion and two side wall portion groups. One of the two side wall portion groups includes a first side wall portion standing on one of two edges of the flat-plate portion in a width direction of the flat-plate portion, and the other of the two side wall portion groups includes a second side wall portion standing on the other of the two edges of the flat-plate portion. The second side wall portion is a spring portion which generates pressing force in the width direction. The first side wall portion faces the second side wall portion. The flat-plate portion of the unit structure has equally spaced gap portions which extend toward a centerline of the flat-plate portion in the unit structure. The unitary structure has a length m times the interval between two of the gap portions which are adjacent in the longitudinal direction, where m is a value obtained by adding a positive integer not less than 1 to a value obtained as a result of dividing a length in the longitudinal direction of the unit structure by the interval.

Effects of the Invention

According to the present invention, it is possible to inexpensively produce connector covers having respective lengths appropriate for connectors different in the number of contacts.

DETAILED DESCRIPTION OF THE EMBODIMENTS

An embodiment of the present invention will be described below with reference to the drawings.

A "continuous structure capable of producing a connector cover" (hereinafter abbreviated as a "continuous structure") according to the embodiment is made from a single strip-shaped flat plate (that is, a flat plate in the shape of an elongated rectangle). The continuous structure is or includes a series structure (that is, a long body, which will be described later) in which a predetermined structure (hereinafter referred to as a "unit structure") repeatedly and regularly appears in a line along a longitudinal direction (hereinafter referred to as a "direction L") of the strip-shaped flat plate. In other words, the continuous structure is or includes a periodic structure (that is, a long body, which will be described later) in which two or more unit structures are seamlessly and linearly coupled. The continuous structure is manufactured through, for example, continuous press working of a long metal plate of stainless steel or the like.

Figure 1A:
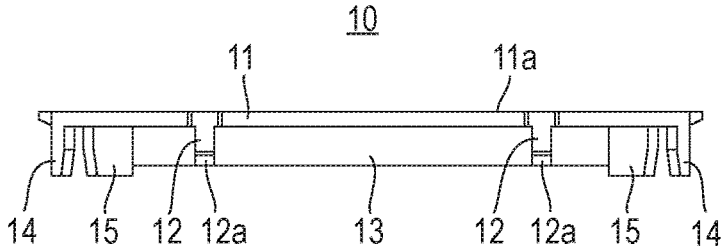
FIG. 1A PRIOR ART
FIG. 1A is a front view of a conventional connector cover.
Figure 1B:
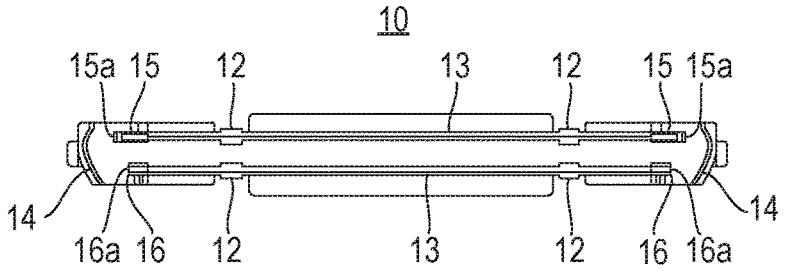
FIG. 1B PRIOR ART
FIG. 1B is a bottom view of the connector cover shown in FIG. 1A.
Figure 2A:
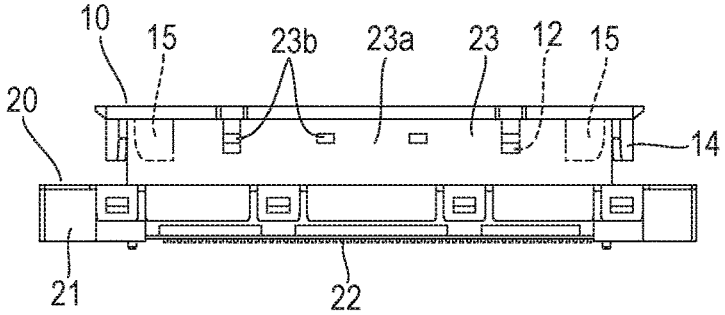
FIG. 2A PRIOR ART
FIG. 2A is a front view of a connector having a small number of contacts, to which the connector cover shown in FIG. 1A is attached.
Figure 2B:
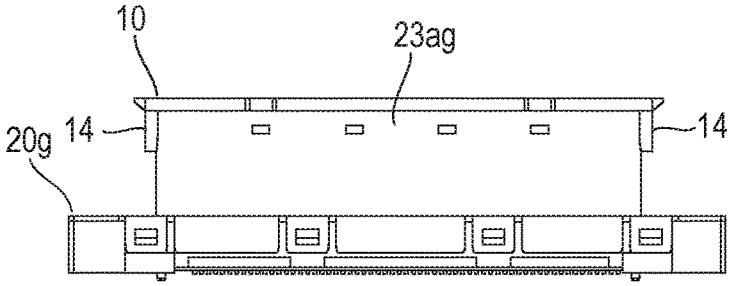
FIG. 2B PRIOR ART
FIG. 2B is a front view of a connector having a large number of contacts, to which the connector cover shown in FIG. 1A is attached.
Figure 3:
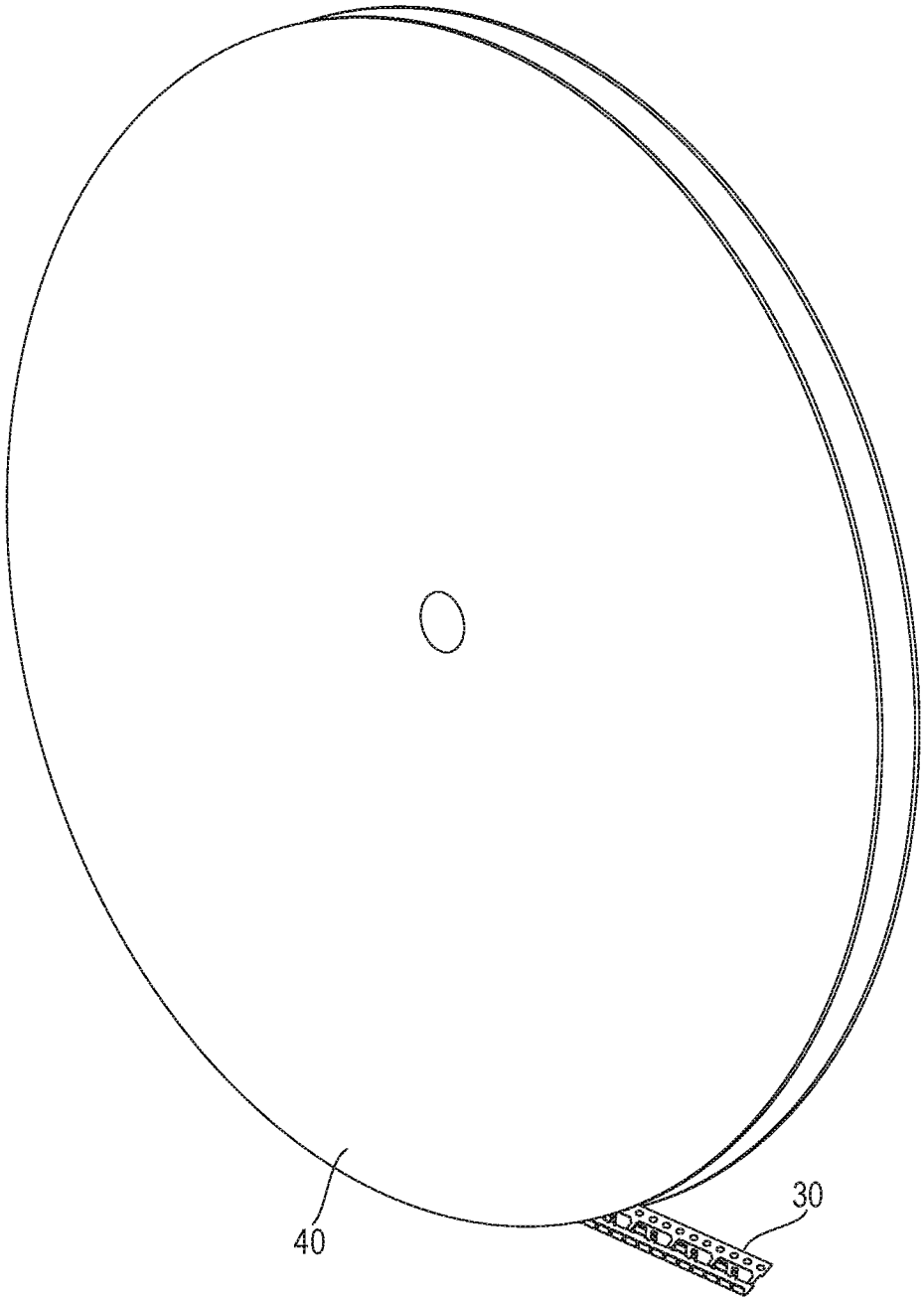
FIG. 3 is a perspective view of a continuous structure which is wound on a reel.
Figure 4A:
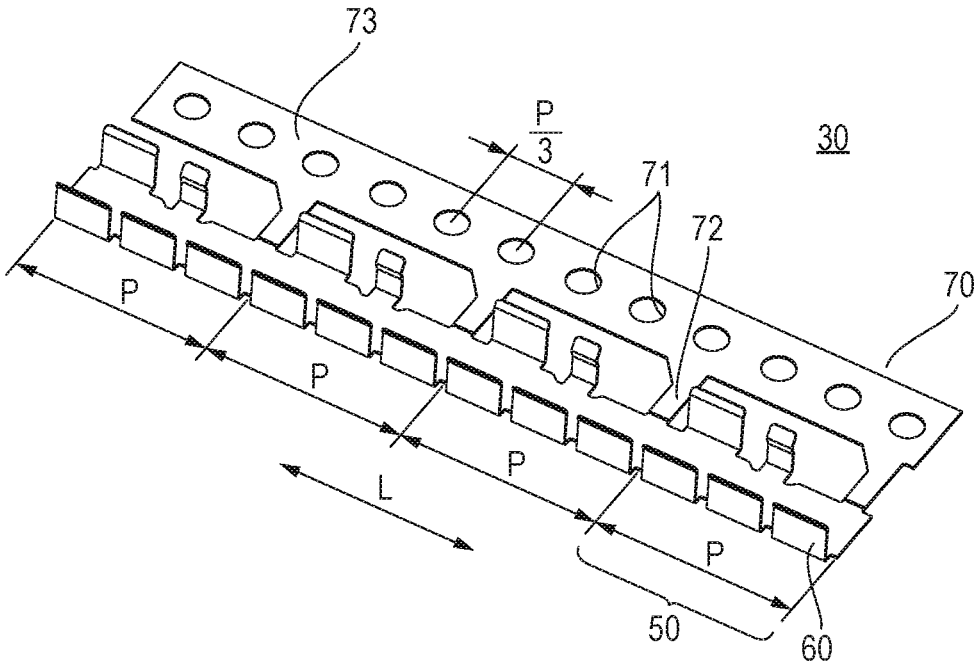
FIG. 4A is a perspective view of a fragment of the continuous structure shown in FIG. 3.

FIG. 3 shows a continuous structure 30 which is wound on a reel 40. FIG. 4A shows details of a fragment of the continuous structure 30.

The continuous structure 30 includes a long body 60 in which a unit structure 50 repeatedly and regularly appears in a line in the direction L and a carrier 70 which extends in the direction L along the long body 60. The carrier 70 that has an elongated flat-plate shape is formed integrally with the long body 60.

The carrier 70 is a component which functions to feed a metal plate in predetermined pitches into a die at the time of press working. Reference character P in FIG. 4A denotes the value of a press pitch. The unit structure 50 appears repeatedly at intervals of the pitch of P. That is, a dimension (length) in the direction L of the unit structure 50 is P. The carrier 70 includes an elongated flat-plate portion 73 which extends in the direction L and flat plate-shaped bridge portions 72 which extend from the flat-plate portion 73 to the long body 60. Pilot holes 71 which are arranged at even intervals in the direction L are formed in the flat-plate portion 73. An arrangement pitch for the pilot holes 71 is P/3 in this example. An arrangement pitch for the bridge portions 72 is P. Each bridge portion 72 is coupled to the unit structure 50 to support the unit structure 50.

Figure 4B:
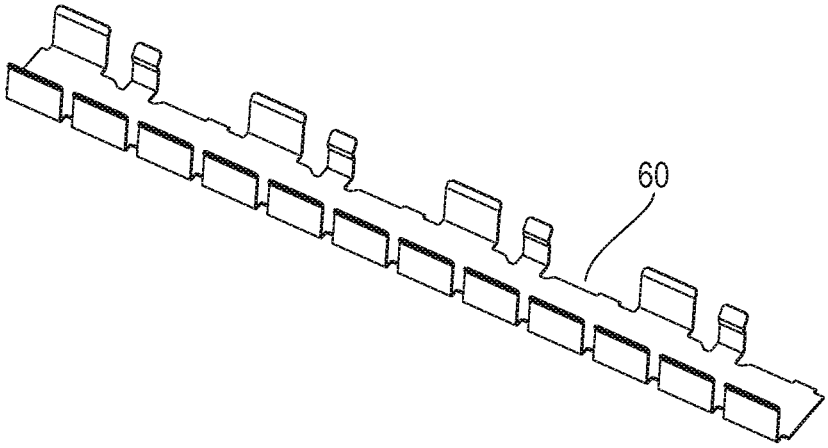
FIG. 4B is a perspective view of the fragment shown in FIG. 4A with a carrier removed.
Figure 4C:
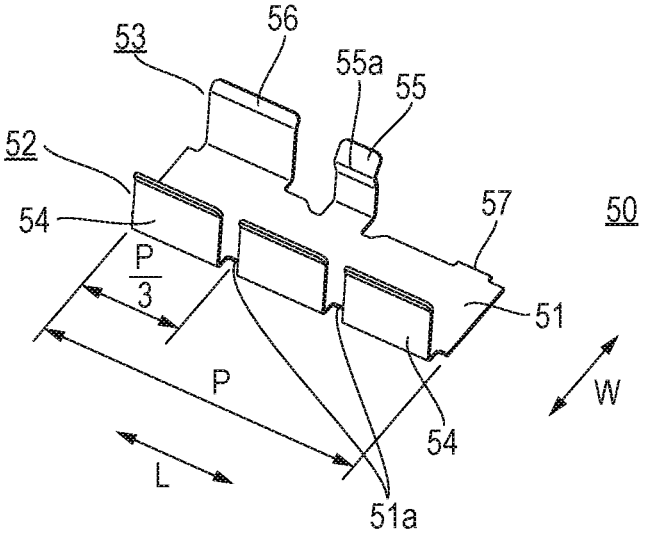
FIG. 4C is a perspective view of a unit structure in the continuous structure shown in FIG. 3.

FIG. 4B shows a state in which the carrier 70 is removed from the continuous structure 30 shown in FIG. 4A by cutting the bridge portions 72. FIG. 4C is an enlarged view of the unit structure 50.

The unit structure 50 includes a flat-plate portion 51 and two side wall portion groups 52 and 53. The side wall portion group 52 on one side includes at least one side wall portion standing almost upright on one of two edges of the flat-plate portion 51 in a width direction of the flat-plate portion 51. The width direction is a direction orthogonal to the direction L and is hereinafter referred to a "direction W". The side wall portion group 53 on the other side includes at least one side wall portion standing almost upright on the other of the two edges of the flat-plate portion 51 in the direction W. The one or more side wall portions included in the side wall portion group 52 or 53 are formed by bending rectangular metal plate portions, which extend from an edge in the direction W of a long metal plate portion to serve as the flat-plate portion 51, at a right angle in the same direction at the time of working. The side wall portion group 52 in this example includes three side wall portions 54 which are lined up in the direction L. An arrangement pitch for the three side wall portions 54 is P/3. Adjacent two of the side wall portions 54 form a slot. A region with a dimension of P/3 in the direction L is hereinafter referred to as a section.

The side wall portion group 53 in this example includes a side wall portion 55 (hereinafter referred to as a "spring portion") and a side wall portion 56 which are lined up in the direction L. The spring portion 55 is located in a central section in the direction L. The side wall portion 56 is located in a section at one end portion. The spring portion 55 faces in the direction W the side wall portion 54 in the central section of the side wall portion group 52. The spring portion 55 generates pressing force in the direction W, specifically generates pressing force facing toward the inside of the unit structure 50 (that is, facing toward the side wall portion 54) in this example. A protruding portion 55*a* which protrudes toward the inside of the unit structure 50 is formed near a distal end of the spring portion 55. The protruding portion 55*a* is formed by flexing the spring portion 55.

The side wall portion 56 has a shape plane-symmetric to the side wall portion 54 facing the side wall portion 56 in the direction W Respective distal ends of the side wall portion 56 and the three side wall portions 54 are slightly bent and face toward the outside of the unit structure 50. A portion in one remaining section of the side wall portion group 53 is a portion to be coupled to the bridge portion 72 of the carrier 70. Reference numeral 57 in FIG. 4C denotes a mark left after the bridge portion 72 is cut.

A structure in which two or more unit structures 50 each having the above-described structure are seamlessly coupled in a longitudinal direction of the flat-plate portion 51 is the long body 60 extending in the direction L. One end of a slot formed by adjacent two of the side wall portions 54 is an open end while the other end encroaches slightly on the flat-plate portion 51. In other words, gap portions 51*a* are formed on one of the two edges of the flat-plate portion 51, the gap portions 51*a* being each a slit extending from the one of the two edges of the flat-plate portion 51 toward a centerline, which is an imaginary line extending in the direction L obtained by connecting midpoints in the width direction of the flat-plate portion 51, of the flat-plate portion 51. Since the above-described rectangular metal plate portions are bent at bending positions close to an edge of the above-described long metal plate portion along a line segment parallel to the edge, a space between portions adjacent in the direction L of the flat-plate portion 51, which each have a width corresponding to the distance between the corresponding bending position and the edge, corresponds to the gap portion 51*a*. In this example, the gap portions 51*a* are located at sites of the flat-plate portion 51 corresponding to positions on two sides of each side wall portion 54. A gap portion may be formed on the other of the two edges of the flat-plate portion 51. In this case, gap portions are located at sites of the flat-plate portion 51 corresponding to positions on two sides of a side wall portion (specifically, the spring portion 55 or the side wall portion 56). When gap portions are formed on the two edges of the flat-plate portion 51, gap portions which are formed on one of the two edges of the flat-plate portion 51 and gap portions which are formed on the other of the two edges of the flat-plate portion 51 preferably face each other in the direction W: When a side wall portion group includes two or more side wall portions, a gap portion on the right side of one of two adjacent side wall portions preferably coincides with a gap portion on the left side of the other (that is, one gap portion is present between the two adjacent side wall portions). The length of one section corresponds to the distance between two gap portions adjacent in the direction L. In this example, gap portions are located at even intervals in the direction L (see FIG. 4B), and an integral multiple of the length of one section is equal to the length in the direction L of the unit structure 50.

The continuous structure 30 wound on the reel 40 is unwound from the reel 40 at the time of production of connector covers. The continuous structure 30 is cut to a desired length in accordance with the number of contacts of a connector. The carrier 70 is removed after the cutting, thereby obtaining a connector cover having a size corresponding to the number of contacts of the connector. Thus, the connector cover is made from a single strip-shaped flat plate and has a structure having a part of a regular repetition of the above-described unit structure along in a longitudinal direction of the strip-shaped flat plate.

Figure 5A:
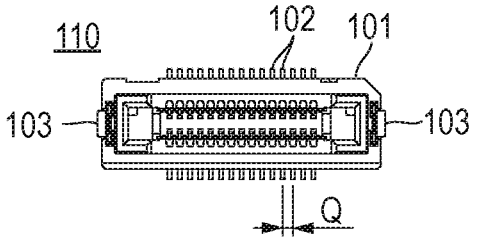
FIG. 5A is a plan view of a 30-contact connector.
Figure 5B:
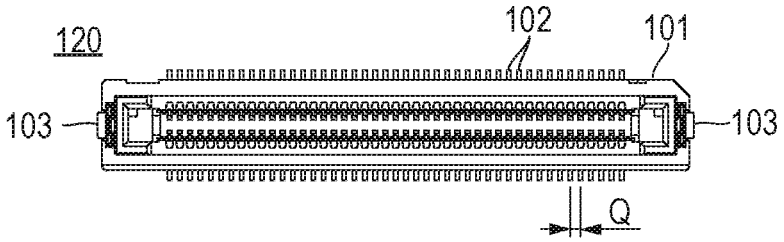
FIG. 5B is a plan view of a 90-contact connector.
Figure 5C:
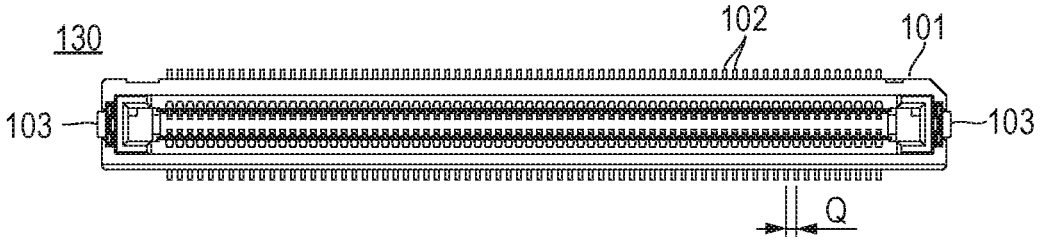
FIG. 5C is a plan view of a 140-contact connector.
Figure 6A:
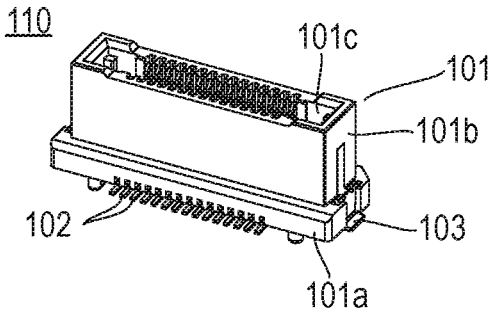
FIG. 6A is a perspective view of the connector shown in FIG. 5A.
Figure 6B:
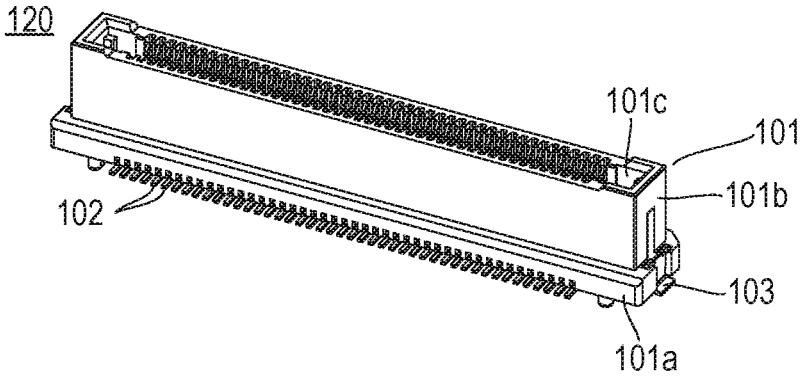
FIG. 6B is a perspective view of the connector shown in FIG. 5B.
Figure 6C:
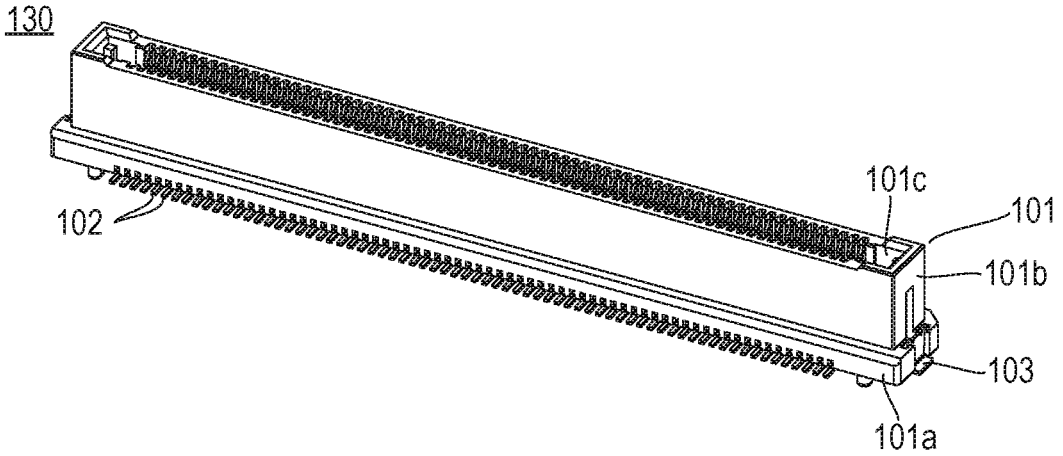
FIG. 6C is a perspective view of the connector shown in FIG. 5C.

FIGS. 5A to 5C and 6A to 6C show, as examples, connectors different in the number of contacts. By way of example, plan views of a 30-contact connector 110, a 90-contact connector 120, and a 140-contact connector 130 are shown in FIGS. 5A to 5C, and perspective views thereof are shown in FIGS. 6A to 6C. A connector cover is to be attached to a mating portion of a connector.

Each connector 110, 120, or 130 includes an insulator 101, contacts 102, and reinforcing metal fittings 103. The insulator 101 includes a base portion 101*a* and a mating portion 101*b*. A mating opening 101*c* is formed in an upper surface of the mating portion 101*b*. The contacts 102 are divided into two groups in this example, and the contacts 102 in each group are lined up in a row. One end of each contact 102 is located at an inner wall surface of the mating opening 101*c*, and the other end of the contact 102 protrudes from the base portion 101*a*. The connectors 110, 120, and 130 are identical in dimensions to one another except that the connectors 110, 120, and 130 have the insulators 101 (specifically, the mating portions 101*b*) having different lengths corresponding to the numbers of contacts. The reinforcing metal fittings 103 are attached to side surfaces at two ends in a length direction of the insulator 101.

Assume that an arrangement pitch for the contacts 102 is Q in the connector 110, 120, or 130. The relationship P=15Q holds between the pitch of Q and the pitch of P for the unit structures 50. That is, one section (=P/3) in the unit structure 50 has a length five times the pitch of Q for the contacts 102.

As described earlier, one side wall portion 54 is formed for each section in the unit structure 50. Thus, a portion without the side wall portion 54 (that is, a portion with only the flat-plate portion 51) is present for every section, that is, every five pitches (=5Q) for the contacts 102. A connector cover is produced in this example by cutting the continuous structure 30 at a position of the portion without the side wall portion 54. That is, a cutting position is a position of the gap portion 51*a* in the flat-plate portion 51. Since the contacts 102 are lined up in two rows in the connector 110, 120, or 130, the length of a connector cover can be changed in basic units of 10 contacts by changing a cutting position.

Figure 7A:
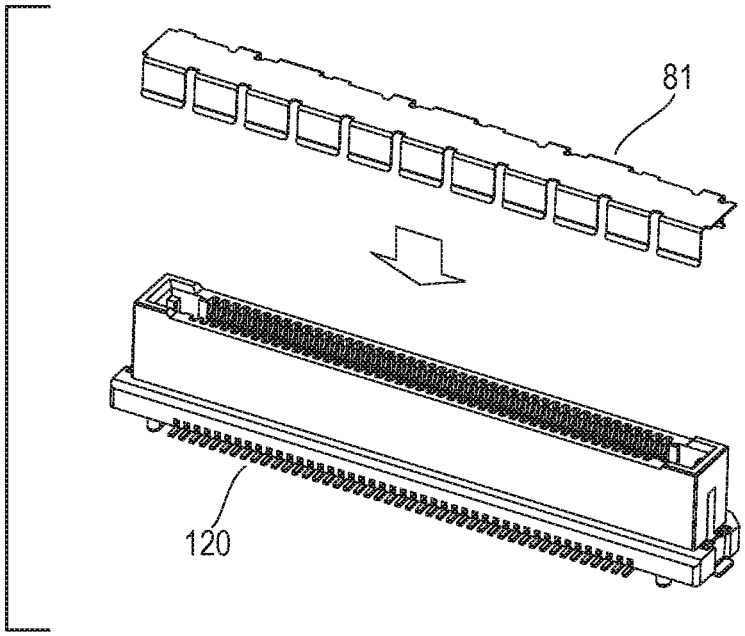
FIG. 7A is a perspective view for explaining attachment of a connector cover to the connector shown in FIG. 5B.
Figure 7B:
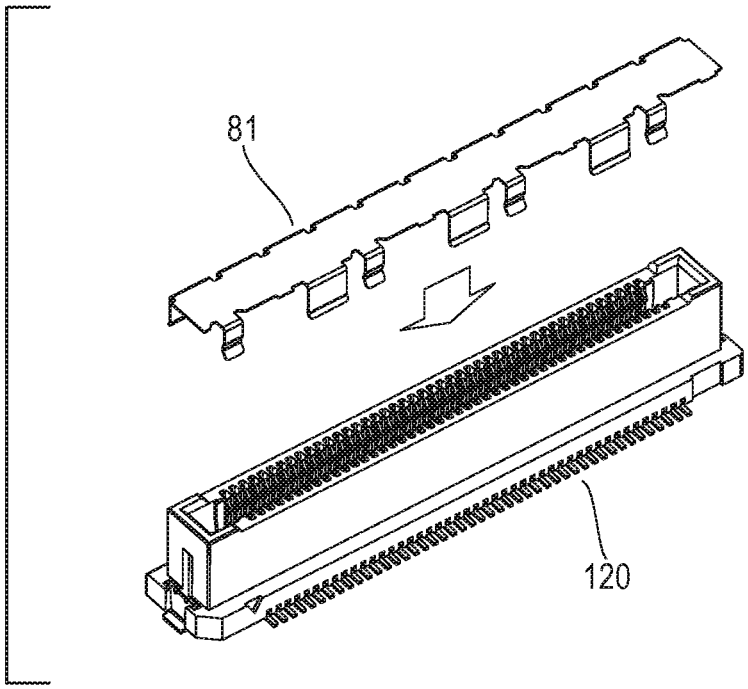
FIG. 7B is a perspective view for explaining the attachment of the connector cover to the connector shown in FIG. 5B, as seen from a viewpoint different from that in FIG. 7A.

FIGS. 7A and 7B show a situation in which a connector cover is attached to the 90-contact connector 120. A connector cover 81 has a structure corresponding to three pitches and two sections in the long body 60 and has a length of 3P+(⅔)P.

Figure 8A:
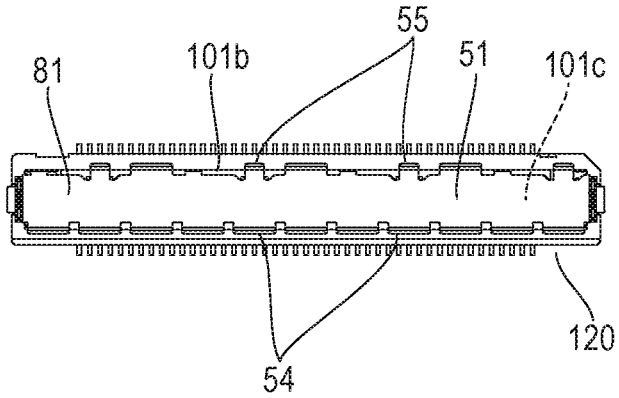
FIG. 8A is a plan view showing a state in which the connector cover is attached to the connector shown in FIG. 5B.
Figure 8B:
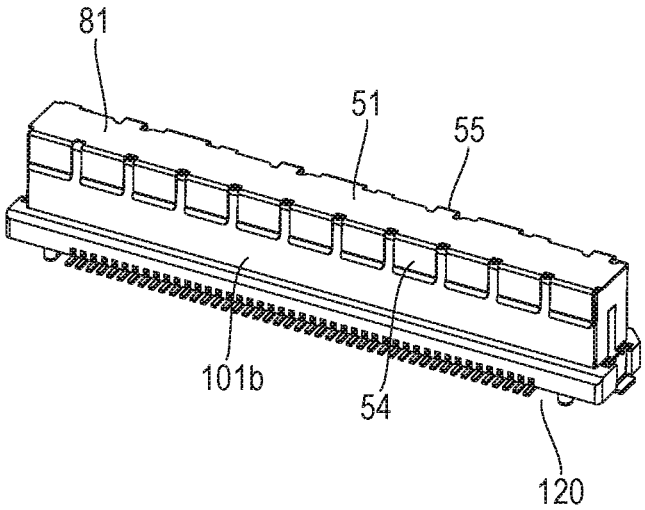
FIG. 8B is a perspective view showing the state in which the connector cover is attached to the connector shown in FIG. 5B.

FIGS. 8A and 8B show the connector 120 with the connector cover 81 attached to the mating portion 101*b*. The mating portion 101*b* is sandwiched between the spring portions 55 and the side wall portions 54 of the connector cover 81. With this configuration, the connector cover 81 is fixed to the mating portion 101*b*. The mating opening 101*c* of the connector 120 is closed by the flat-plate portion 51 of the connector cover 81.

Figure 9A:
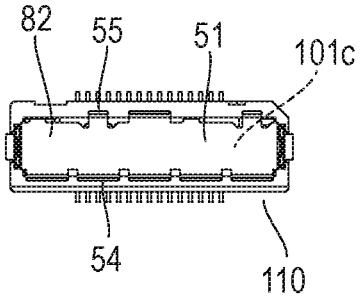
FIG. 9A is a plan view showing a state in which a connector cover is attached to the connector shown in FIG. 5A.
Figure 9B:
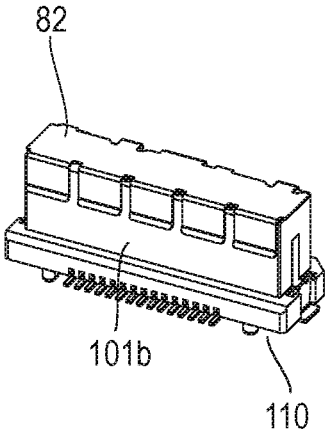
FIG. 9B is a perspective view showing the state in which the connector cover is attached to the connector shown in FIG. 5A.
Figure 10A:
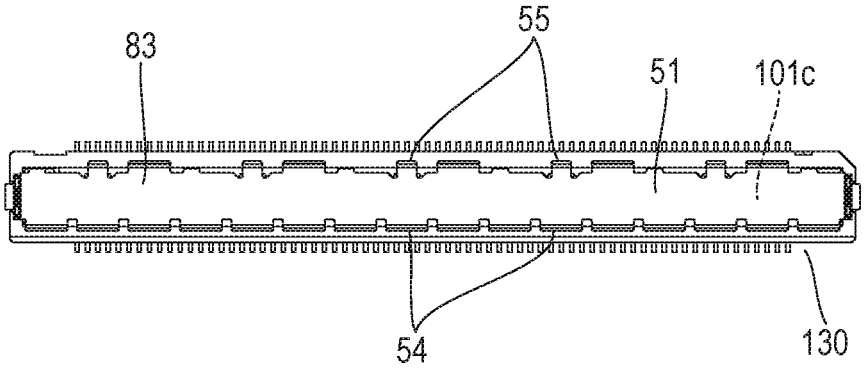
FIG. 10A is a plan view showing a state in which a connector cover is attached to the connector shown in FIG. 5C.
Figure 10B:
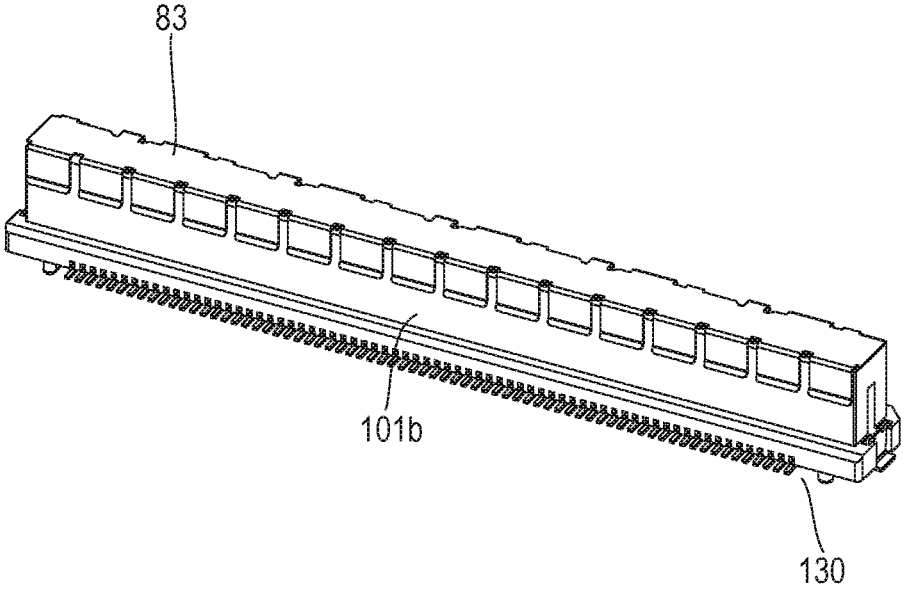
FIG. 10B is a perspective view showing the state in which the connector cover is attached to the connector shown in FIG. 5C.

FIGS. 9A and 9B show the 30-contact connector 110 with a connector cover 82 attached to the mating portion 101*b*. FIGS. 10A and 10B show the 140-contact connector 130 with a connector cover 83 attached to the mating portion 101*b*. The connector cover 82 has a structure corresponding to one pitch and two sections in the long body 60, and the connector cover 83 has a structure corresponding to five pitches and one section in the long body 60.

As can be seen from the embodiment, a connector cover has a structure in which the unit structure 50 appears repeatedly n times (n is a number larger than 1 but is not limited to an integer, when a unit structure is used as a unit of measure). From a different viewpoint, when an integral multiple of the length of one section is equal to the length in the direction L of the unit structure 50, the connector cover has a length m times one section (m is a value obtained by adding a positive integer not less than 1 to a value obtained as a result of dividing the length in the direction L of the unit structure 50 by the length of one section). Thus, the connector cover always includes at least one unit structure 50 or, more specifically, the spring portion 55 and the side wall portion 54 facing the spring portion 55 as a pair.

Figure 11A:
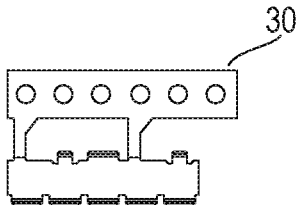
FIG. 11A is a view showing a connector cover with a carrier for a connector having 30 contacts.
Figure 11B:
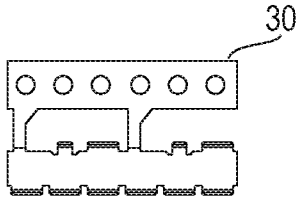
FIG. 11B is a view showing a connector cover with a carrier for a connector having 40 contacts.
Figure 11C:
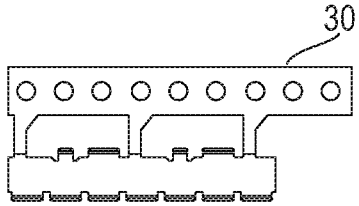
FIG. 11C is a view showing a connector cover with a carrier for a connector having 50 contacts.
Figure 11D:
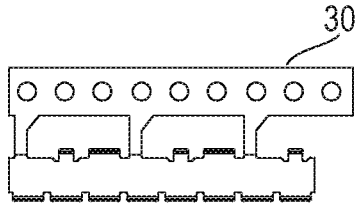
FIG. 11D is a view showing a connector cover with a carrier for a connector having 60 contacts.
Figure 11E:
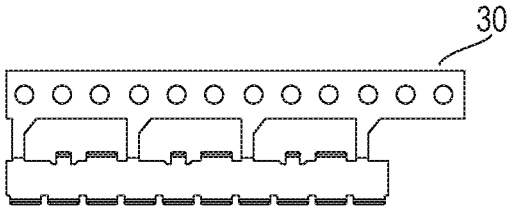
FIG. 11E is a view showing a connector cover with a carrier for a connector having 80 contacts.
Figure 11F:
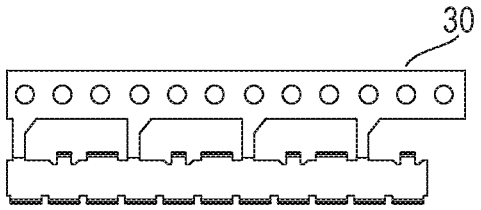
FIG. 11F is a view showing a connector cover with a carrier for a connector having 90 contacts.
Figure 11G:
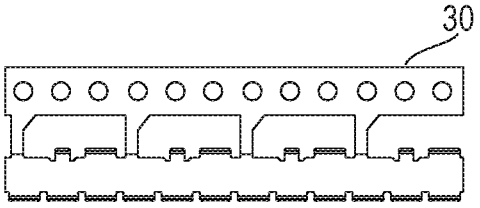
FIG. 11G is a view showing a connector cover with a carrier for a connector having 100 contacts.
Figure 11H:
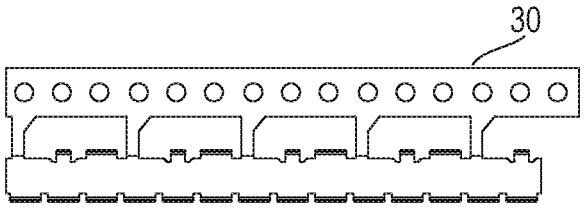
FIG. 11H is a view showing a connector cover with a carrier for a connector having 120 contacts.

FIGS. 11A to 11H show examples of use of the continuous structure 30 for connectors having various numbers of contacts. A connector cover for a 30-contact connector has a structure corresponding to one pitch and two sections in a long body (FIG. 11A). A connector cover for a 40-contact connector has a structure corresponding to two pitches in a long body (FIG. 11B). A connector cover for a 50-contact connector has a structure corresponding to two pitches and one section in a long body (FIG. 11C). A connector cover for a 60-contact connector has a structure corresponding to two pitches and two sections in a long body (FIG. 11D). A connector cover for an 80-contact connector has a structure corresponding to three pitches and one section in a long body (FIG. 11E). A connector cover for a 90-contact connector has a structure corresponding to three pitches and two sections in a long body (FIG. 11F). A connector cover for a 100-contact connector has a structure corresponding to four pitches in a long body (FIG. 11G). A connector cover for a 120-contact connector has a structure corresponding to four pitches and two sections in a long body (FIG. 11H).

As can be seen from the above description, a connector cover according to the embodiment is made from a single strip-shaped flat plate and has a structure having a part of a regular repetition of the unit structure in a longitudinal direction of the strip-shaped flat plate. When gap portions which extend from an edge of the flat-plate portion 51 toward the centerline of the flat-plate portion 51 are formed at even intervals in the direction L on at least one of the two edges of the flat-plate portion 51 in the unit structure 50, the connector cover has a length which is m times the interval between two gap portions adjacent in the direction L (m is a value obtained by adding a positive integer not less than 1 to a value obtained as a result of dividing the length in the direction L of the unit structure 50 by the interval). A side wall portion (which, when a side wall portion group includes two or more side wall portions, is replaced with "each of the side wall portions") is located between two gap portions adjacent in the direction L. Note that the converse of the description, that is, the proposition that "one side wall portion is always included between two gap portions adjacent in the direction L" does not hold.

A connector cover is produced by cutting a part having a length corresponding to the number of contacts of a connector out of a continuous structure. It is thus possible to inexpensively produce connector covers of respective sizes appropriate for various connectors different in the number of contacts. That is, a connector cover does not have an inappropriate length (that is, an excessive length) for a connector.

The unit structure 50 in the continuous structure 30 needs to include at least one spring portion 55 and one side wall portion 54 facing the spring portion 55. In this respect, when the side wall portion 54 is present for every section, and the side wall portion 56 is also present, as in the embodiment, the continuous structure 30 can be easily and systematically wound on the reel 40. The presence of the side wall portion 56 contributes to protection of the spring portion 55.

Unlike the embodiment, the spring portion 55 may have a structure which generates pressing force facing toward the outside of the unit structure. In this case, at the time of attachment of a connector cover to a connector, at least the spring portion 55 and the side wall portion 54 facing the spring portion 55 are inserted into the mating portion 101*b* through the mating opening 101*c*. Pressing force of the spring portion 55 pushes the spring portion 55 and the side wall portion 54 against the inner wall surface of the mating opening 101*c*, and the connector cover is fixed to the mating portion 101*b*.

One section in the unit structure 50 is not limited to one-third of the pitch of P. One section is not limited to five times the pitch of Q.

In the continuous structure 30, the carrier 70 is not an essential constituent element. Since the continuous structure 30 needs to be fed in predetermined feed pitches into a die at the time of cutting-out of a connector cover, the continuous structure 30 preferably includes the carrier 70.

A flat-plate portion of a connector cover is used as a suction component at the time of automatic mounting of a connector on a board. After the connector is mounted on the board, the flat-plate portion can be used as a protective cover. That is, continued attachment of a connector cover to a connector after mounting allows prevention of entry of a foreign substance into a mating opening, and the connector cover functions as a protective cover. Since a connector cover has a size corresponding to the size of a connector, the presence of the connector cover does not cause formation of dead space.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A continuous structure capable of producing a connector cover, comprising or being a unitary structure made from a single strip-shaped flat plate, the unitary structure including a regular repetition of a predetermined structure in a longitudinal direction of the strip-shaped flat plate, the predetermined structure being referred to as a unit structure, the unit structure including a flat-plate portion and two side wall portion groups, one of the two side wall portion groups including a first side wall portion standing on one of two edges of the flat-plate portion in a width direction of the flat-plate portion, another of the two side wall portion groups including a second side wall portion standing on the other of the two edges of the flat-plate portion, the second side wall portion being a spring portion generating pressing force in the width direction, the first side wall portion facing the second side wall portion, the flat-plate portion of the unit structure having gap portions, the gap portions extending toward a centerline of the flat-plate portion in the unit structure, the gap portions being located at sites of the flat-plate portion in the unit structure, the sites corresponding to positions of two sides of the first or second side wall portion, the gap portions being equally spaced, and the continuous structure being cuttable at a position of one of the gap portions to produce the connector cover having a length m times an interval between two of the gap portions adjacent in the longitudinal direction, m being a value obtained by adding a positive integer not less than 1 to a value obtained as a result of dividing a length in the longitudinal direction of the unit structure by the interval.

2. The continuous structure according to claim 1, wherein the continuous structure includes a carrier extending in the longitudinal direction, the carrier is formed integrally with the unitary structure, the carrier includes a flat-plate portion extending in the longitudinal direction and a bridge portion extending from the flat-plate portion to the unitary structure, and pilot holes arranged in the longitudinal direction are formed in the flat-plate portion of the carrier.

3. The continuous structure according to claim 2, wherein a third side wall portion is included in either one of the two side wall portion groups.

4. The continuous structure according to claim 1, wherein a third side wall portion is included in either one of the two side wall portion groups.

5. A method for producing a connector cover, comprising:

cutting the continuous structure according to claim 1 to a length including the first and second side wall portions as a pair.

6. A method for producing a connector cover, comprising:

cutting the continuous structure according to claim 1 at a position of one of the gap portions.

7. A connector cover, comprising or being a unitary structure made from a single strip-shaped flat plate, the unitary structure having a part of a regular repetition of a predetermined structure in a longitudinal direction of the strip-shaped flat plate, the predetermined structure being referred to as a unit structure, the unit structure including a flat-plate portion and two side wall portion groups, one of the two side wall portion groups including a first side wall portion standing on one of two edges of the flat-plate portion in a width direction of the flat-plate portion, another of the two side wall portion groups including a second side wall portion standing on the other of the two edges of the flat-plate portion, the second side wall portion being a spring portion generating pressing force in the width direction, the first side wall portion facing the second side wall portion, the flat-plate portion of the unit structure having equally spaced gap portions extending toward a centerline of the flat-plate portion in the unit structure, and the unitary structure having a length m times an interval between two of the gap portions adjacent in the longitudinal direction, m being a value obtained by adding a positive integer not less than 1 to a value obtained as a result of dividing a length in the longitudinal direction of the unit structure by the interval.

8. A method for producing a connector cover from a continuous structure, the continuous structure comprising or being a unitary structure made from a single strip-shaped flat plate, wherein the unitary structure includes a regular repetition of a predetermined structure in a longitudinal direction of the strip-shaped flat plate, the predetermined structure being referred to as a unit structure, the unit structure includes a flat-plate portion and two side wall portion groups, one of the two side wall portion groups includes a first side wall portion standing on one of two edges of the flat-plate portion in a width direction of the flat-plate portion, another of the two side wall portion groups includes a second side wall portion standing on the other of the two edges of the flat-plate portion, the second side wall portion is a spring portion generating pressing force in the width direction, the first side wall portion faces the second side wall portion, gap portions extending toward a centerline of the flat-plate portion in the unit structure are formed in the flat-plate portion of the unit structure, and the gap portions are located at sites of the flat-plate portion in the unit structure, the sites corresponding to positions of two sides of the first or second side wall portion, the method comprising:

cutting the continuous structure at a position of one of the gap portions.

* * * * *